United States Patent [19]

Hawn

[11] 3,986,610

[45] Oct. 19, 1976

[54] CANISTER FOR A BOTTLE AND THE LIKE

[75] Inventor: Robert E. Hawn, Mayfield, Ky.

[73] Assignee: Roman Ceramics, Mayfield, Ky.

[22] Filed: Jan. 29, 1975

[21] Appl. No.: 545,103

[52] U.S. Cl. ..... 206/521; 215/12 R; 206/457; 220/17

[51] Int. Cl.[2] ..... B65D 11/16; B65D 81/02

[58] Field of Search ..... 229/8; 206/457, 521; 215/12 R; 220/378, 17

[56] References Cited

UNITED STATES PATENTS

| | | | |
|---|---|---|---|
| 719,612 | 2/1903 | Russell | 215/12 R |
| 3,712,462 | 1/1973 | Gabor et al. | 206/521 |
| 3,819,081 | 6/1974 | Runte | 220/17 |
| R3,115 | 2/1856 | Lewis | 220/378 |

FOREIGN PATENTS OR APPLICATIONS

| | | | |
|---|---|---|---|
| 553,175 | 1923 | France | 215/12 R |

*Primary Examiner*—William Price
*Assistant Examiner*—Douglas B. Farrow
*Attorney, Agent, or Firm*—Max R. Kraus

[57] ABSTRACT

A canister for supporting and retaining a bottle and the like, which canister comprises a hollow base formed of a ceramic material and a hollow cylindrical-shaped cover also formed of a ceramic material positionable on the base to completely enclose a bottle between the base and the hollow cylindrical cover. The base has a dish or cup-shaped retainer formed of a plastic material having a resiliency to receive the bottom of the bottle and frictionally retain and cushion same. The cover has an inverted cup-shaped retainer secured to the top end wall of the cover and inverted with respect to the dish or cup-shaped retainer of the base. The inverted cup-shaped retainer on the cover extends into the interior of the cover and is adapted to receive the closed cap of the bottle. Both of said retainers retain the bottle in a fixed position inside the canister spaced from contact with the walls of the base and the cover and at the same time cushion the bottle. The canister forms a decorative housing to conceal the bottle and its contents from normal view, however, the cover is readily removable from the base so that the bottle may be removed from the base for the purpose of use. To prevent chipping of the porcelain during shipment and transporting of the canister and the bottle therewith, there is provided a collar member positioned between the top of the base and the bottom of the cover to keep the porcelain edges from engaging each other and also providing a close fit between the cover and the base. The collar is readily removable for discarding when the canister is placed in use.

10 Claims, 5 Drawing Figures

CANISTER FOR A BOTTLE AND THE LIKE

BRIEF SUMMARY OF THE INVENTION

One of the objects of this invention is to provide a canister comprising a hollow base and a cylindrical-shaped cover, with the base and the cover having means for detachably securing a bottle or container, such as a liquor bottle, therewithin to hold said bottle in a fixed position spaced from the walls of the base and the cover. It also serves as a decorative housing for the bottle during the use thereof.

Another object of this invention is to provide a canister of the foregoing character in which the base and the cover are formed of a decorative ceramic material of distinctive design so as to provide an ornamental canister to hide the bottle and its contents from view.

Another object of this invention is to provide a protective collar which is positioned between the top of the base and the bottom edge of the cover to prevent engagement of same therebetween during shipment of the canister and bottle and prevent chipping of the ceramic parts and also to provide a close fit between the cover and base to prevent rattling or movement of the cover with respect to the base.

Another object of this invention is to provide dish or cup-shaped retainers formed of a resilient plastic material fixedly positioned in the base and in the cover which frictionally retains the bottle and the closed cap so that the bottle is held alined in a fixed position within the canister and which permits the bottle to be readily removed from the base whenever it is desired to be used.

Another object of this invention is to provide a canister for a bottle, such as a liquor bottle and the like, whereby the canister and the bottle therewithin may be shipped and transported in a condition so that neither the bottle nor the canister will break or chip.

Figure 5:
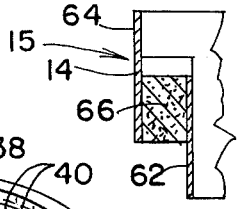
FIG. 5 is an enlarged sectional view taken on line 5—5 of FIG. 3 showing the protective collar.
Figure 4:
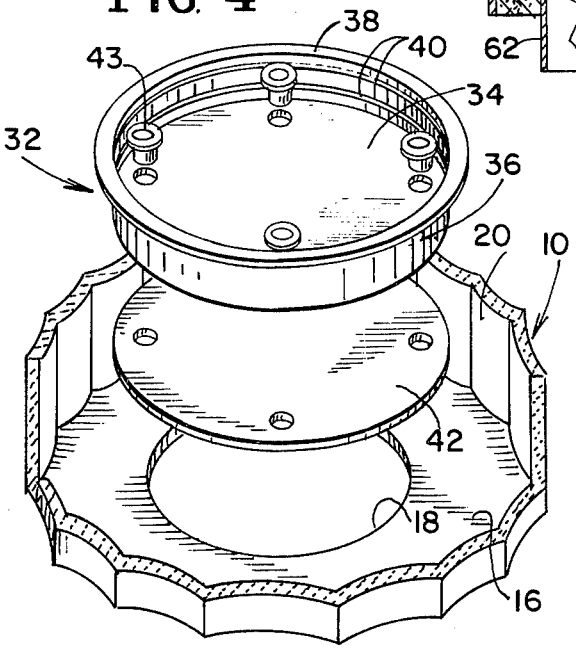
FIG. 4 is an exploded view showing in section a portion of the base and the parts secured to the base for supporting and securing the bottom of the bottle.
Figure 3:
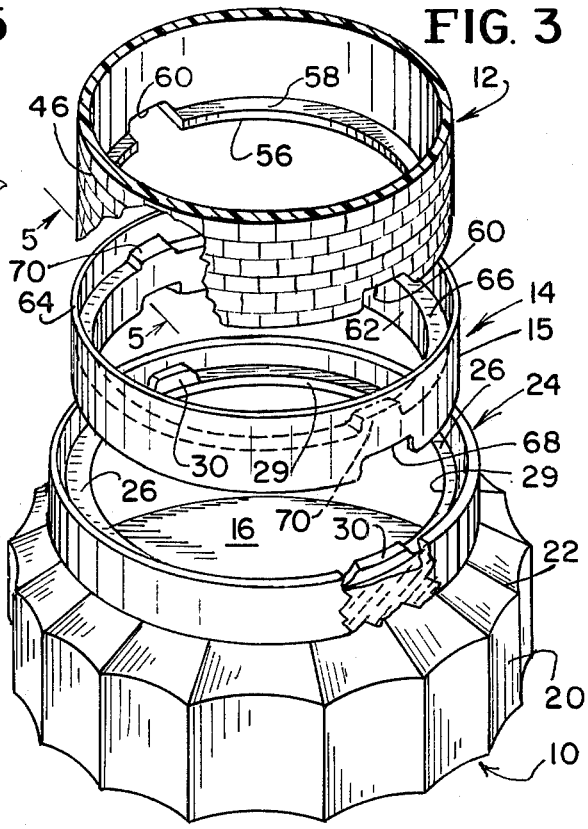
FIG. 3 is an exploded view showing the lower portion of the cover member, the upper portion of the base, and the collar positioned therebetween which is used in the shipment of the bottle within the canister.

The canister comprises a hollow base member generally indicated at 10 and a cylindrical-shaped cover generally indicated at 12 and means in aid base member and said cover for positively positioning and retaining a bottle therewithin and maintaining said bottle in a fixed position during shipment and use of said bottle and canister. Additionally, this invention embraces a protective collar generally indicated at 14 and best shown in FIGS. 3 and 5, which is positioned between the base and the cover to hold the cover with respect to the base and out of contact with each other during shipment to prevent damage to the base and to the cover, both of which are made of a ceramic material. The collar also provides a close fit between the cover and the base and prevents rattling or movement of the cover relative to the base.

More specifically, the hollow base member 12 may be of any desired configuration and shape and may be ornamented as desired. The base member 12 has a bottom wall 16 provided with a central opening 18. Extending upwardly of the base is the side wall body 20 which includes an upwardly and inwardly inclined upper side wall 22 which terminates at the upper end in an annular rim 24, which rim comprises an annular inwardly extending shoulder or ledge 26 with an upwardly extending annular wall 28 extending upwardly of said shoulder. The shoulder or ledge 26 has an inner annular wall 29 and said shoulder is provided with a pair of diametrically positioned projections or upwardly extending lugs 30, which lugs engage diametrically spaced recesses formed in the bottom edge of the cover, to be presently described.

Figure 1:
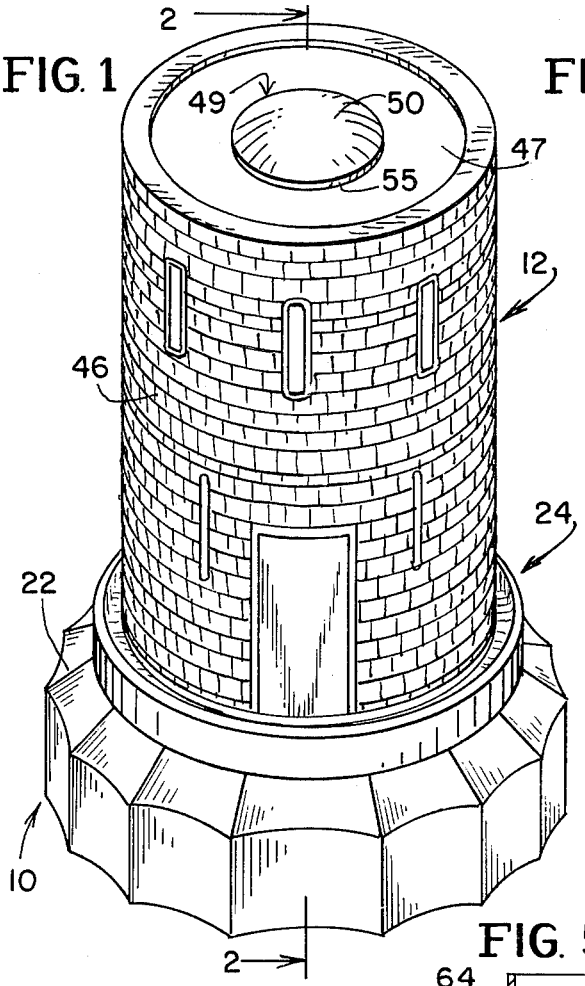
FIG. 1 is a perspective view of the canister.
Figure 2:
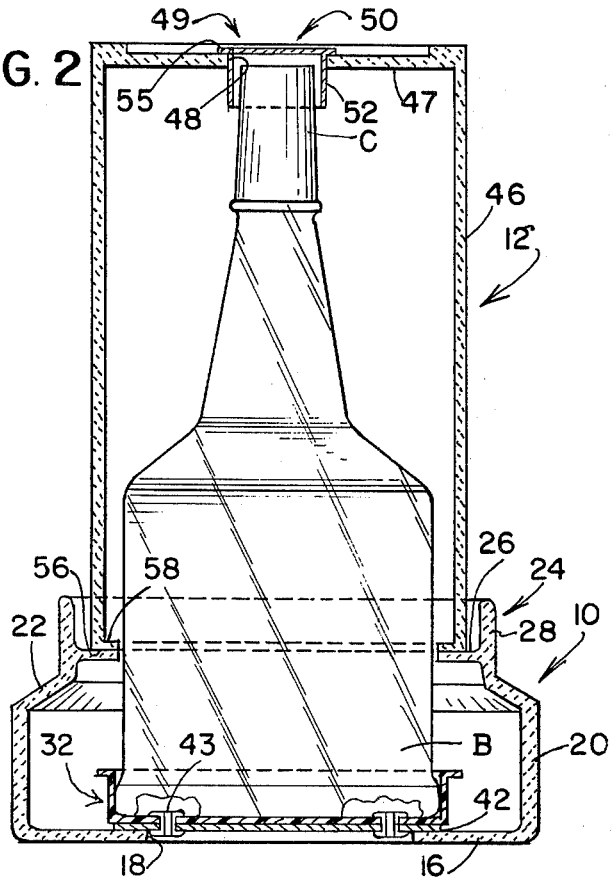
FIG. 2 is a sectional view taken on line 2—2 of FIG. 1, showing same enclosing and supporting a bottle therewithin.

An annular dish or cup-shaped retainer generally indicated at 32 formed of a plastic material which has some "give", such as polyethylene, is used. Said dish or cup-shaped retainer 32 has a bottom wall 34 and an annular upstanding side wall 36 which continues with an outwardly extending annular flange 38. The inside surface of said side wall 36 has spaced annular ribs 40. Secured to the underside of the bottom of the dish or cup-shaped retainer 32 is a disk 42 formed of a fibrous material and said disk is secured to the underside of the bottom 34 of the retainer 32 by spaced eyelets or rivets 43 to secure the two together. As best seen in FIG. 2, the annular opening 18 in the bottom wall 16 of the base member 10 is closed by affixing the disk 42 to the ceramic base by means of an apoxy 44 which serves to permanently affix the disk 42 and retainer 32 to said base. The fibrous disk is sufficiently rigid to provide a support for the bottom wall of the retainer 32 and said fibrous disk 42 makes it possible to secure the plastic retainer 32 to the base, which would be difficult if the plastic retainer 32 were secured directly to the bottom porcelain wall 16 of the porcelain base.

The cover 12 has a cylindrical-shaped body 46 closed at the upper end by a top end wall 47, which top wall has a central annular opening 48. The annular opening 48 is closed by the insertion therein of another retainer generally indicated at 49 which is a cup-shaped plastic member 50 having an annular side wall 52 and an annular end wall 54, which end wall extends exteriorly of the side wall 52 to form an annular flange 55. The retainer 49 is made of the same material as the retainer 32. When the retainer 49 is inserted into the annular top opening 48, the annular side wall 52 thereof extends into the interior of the hollow cylindrical cover and closes the opening 48 in the top end wall of the cover. The top retainer 49 is held secured to the porcelain cover by a friction-tight fit. The retainer 49 is centrally positioned and has a smaller circumference than the bottom retainer 32 in the base. The retainer 49 in the cover 12 is thus inverted in relation to the bottom retainer 32 in the base but is alined therewith so that the bottom of the bottle B rests in the retainer 32 of the base with the screwed-on closure cap C of the bottle resting within the top retainer 49 to hold the bottle in a fixed and detachably secured position within the canister and spaced from the walls of the canister. Both the bottom and top retainers 32 and 49 are such that when the bottle is inserted in the bottom retainer 32, the bottle will be frictionally retained within said retainer, while the cap C of the bottle is retained in the top retainer 49 in a loose fit. Both retainers 32 and 49 also serve to cushion the bottle against breakage during shipment and during use.

The bottom edge 56 of the cylindrical cover 12 has an inwardly extending annular lip 58 and the bottom edge is provided with a pair of diametrically spaced recesses 60 in the bottom edge thereof, which when the cover 12 is positioned on the base register with the upstanding lugs 30 on the rim of the base to prevent relative rotation between the cover and the base. If the poreclain base 10 and porcelain cover 12 were shipped with the bottle therebetween and with the bottom edge 56 of the cover engaging the porcelain shoulder 26 of the base, there would be likelihood that the engaging parts could chip or break and to prevent this and also to better retain the bottle in the canister during shipment there is provided a collar member generally indicated at 15, best shown in FIGS. 3 and 5. The collar 15 may be formed of a material such as styrofoam and is of annular shape and includes a lower inner annular wall 62, an upper outer annular wall 64 and an intermediate annular ledge or shoulder 66 forming a ring-like body, with the upper outer annular wall 64 extending upwardly of the top of the ledge or shoulder 66 and around the exterior of the ledge and offset outwardly of the lower inner all 62. The intermediate ledge 66 has a substantial thickness in contrast to the upper and lower annular walls 64 and 62. The underside of the shoulder or ring portion 66 is provided with a pair of spaced recessed or cutouts 68 diametrically positioned and the top of the ledge is provided with a pair of spaced upwardly extending lugs or projections 70 which are in alinement with the recesses 68.

When shipping the canister with the bottle contained therewithin, the bottle is positioned in the bottom dish or cup-shaped retainer 32 of the base and is held by frictional engagement with said retainer 32 and is centrally positioned so that the bottle does not engage the upstanding wall of said base member but is spaced therefrom. The collar member 14 is next positioned down over the bottle so that the underside of the shoulder 66 of the collar rests on the shoulder 26 of the rim 24 of the base 10, with the recesses or cutouts 68 of the collar shoulder in engagement with the upstanding lugs 30 on the rim 24 of the base. The cylindrical-shaped cover 12 is next positioned on the collar 14 so that the bottom edge 56 of the cover extends within the annular upper wall 64 of the collar and with the recesses 60 in the bottom of the cover engaging the lugs 70 on the collar. The bottom of the cylindrical cover 12 has a close fit within the ring or upper wall 64 of the collar and the bottom inner wall 62 of the collar fits interiorly of the inner annular wall 29 of the rim 26 of the base, thus, the collar provides an effective means for retaining the cover on the base for shipment and transmit. This also secures the cover against relative rotation with respect to the base and keeps the ceramic base and cover from engaging each other during shipment, yet at the same time holding the bottle in a secured position within the canister. At the point of destination or when the customer receives same, the collar can be readily removed and discarded and the cover is applied directly to and is supported on the base, as shown in FIG. 2, with the bottom edge of the cover in engagement with the shoulder or ledge of the base and with the recesses 60 in the cover in engagement with the lugs 30 on the base.

The canister makes a very attractive appearance, serving to provide an ornamental housing for the bottle as it is used. The bottle may contain any liquid but the canister is preferably for use in connection with bottles containing liquor and the like which would be repeatedly used and where it is desired to keep same covered. The liquor bottle may be readily removed from the base for each use by lifting same upwardly thereof and the plastic polyethylene cup or dish-shaped retainer 32 permits the bottle to be eased out of the base and then again reinserted therein to hold same in a positive fixed position with respect to the base. Both the top and bottom retainers serve to hold the bottle in a fixed position relative to the base and the cover so as not to engage the inside walls of either.

What is claimed is:

1. A decorative canister containing and supporting a bottle which is closed by a removable cap at the top thereof, said canister including a hollow base and a hollow cover removably positionable on said base to completely enclose a bottle between said base and hollow cover, said cover being removable by lifting same from said base without unscrewing same therefrom, said base having a shallow cup-shaped retainer fixedly secured to said base to form a single unit therewith and to receive the bottom of the bottle and frictionally retain same in a fixed position, said cover having a retainer fixedly secured to the top end wall of the cover to form a single unit therewith, said cover retainer having a hollow portion extending into said hollow cover with said hollow portion of said cover retainer surrounding at least a portion of said cap and adapted to receive the top closed cap of the bottle so that when said cover is lifted from said base, said cover retainer will simultaneously be disengaged from the cap bottle without unscrewing said cover retainer from said cap bottle, said cover retainer and said base retainer being aligned to retain the bottle in a fixed position inside said canister, said cover retainer having a circumference smaller than the circumference of the base retainer, and said cover and cover retainer being simultaneously removable from said base as a single unit by the mere lifting of said cover without disengaging the cap from the bottle.

2. A canister as set forth in claim 1 in which the base has a top rim with an annular ledge and in which the bottom of the cover rests on said ledge and in which the bottom of the cover has means for engaging means on the ledge to prevent relative rotation of the cover with respect to the base.

3. A canister as set forth in claim 2 which is made of porcelain material and in which the bottom of the cover has recesses engaging projections or lugs on the ledge of the base to prevent relative rotation of the cover with respect to the base.

4. A canister as set forth in claim 1 in which the base and cover are formed of a ceramic material and in which the retainer on the base is formed of a plastic material which has a sufficient give or resiliency to frictionally embrace the bottom of a bottle and retain same therein yet permit the bottle to be manually withdrawn therefrom.

5. A canister as set forth in claim 4 in which the bottom wall of the base has a central opening and in which the cup shaped plastic retainer is secured to a fiber disk with said fiber disk adhesively secured to the ceramic bottom wall of the base to close said bottom opening.

6. A canister as set forth in claim 1 in which the base has an upper rim spaced from the bottom wall of the base, said rim having an inwardly extending shoulder or ledge and an annular wall extending upwardly of said shoulder or ledge, said shoulder or ledge having an inner annular wall surface, said shoulder having a plurality of spaced lugs, the bottom edge of said cover having spaced recesses or cutouts to engage said lugs to prevent relative rotation of said cover relative to said base.

7. A canister as set forth in claim 1 in which the base and cover are formed of porcelain and in which the cover is of a cylindrical shape and in which the top end wall of the cover has an opening which is closed by the retainer in the cover, said retainer being an inverted cup-shaped member formed of plastic material and having a flange extending outwardly of said cup-shaped member, said inverted cup-shaped member extending downwardly into said cover with the flange extending over the top end wall of the cover adjacent said opening.

8. A canister as set forth in claim 1 in which a separate collar is interposed between the base and the cover to prevent engagement of the upper portion of the base with the bottom of said cover during shipment, said collar having a depending inner wall extending into the inside of the top of the base, an intermediate shoulder and an outer upwardly extending wall extending upwardly of said shoulder, said outer upwardly extending wall extending exteriorly of the bottom of said cover and around the bottom of said cover, said collar providing a close fit between the bottom of said cover and the upper portion of said base.

9. A canister as set forth in claim 6 in which the base and cover are formed of porcelain and in which a separate collar is interposed between the base and the cover to provide a close fit therebetween and prevent engagement of the porcelain base and cover, said collar having an upper outer annular wall, an intermediate ledge and a lower inner annular wall, with said upper outer annular wall surrounding the bottom of said cover, with said intermediate ledge resting on the inwardly extending shoulder or ledge of the rim of the base and with said lower inner annular wall positioned inwardly of said inner annular wall surface of said shoulder or ledge.

10. A canister as set forth in claim 9 in which the shoulder or ledge of the base has upstanding projections which engage recesses in the underside of the shoulder of the collar to prevent relative rotation therebetween and in which the top of the shoulder of the collar has projections which engage recesses in the bottom of the cover to prevent relative rotation of the cover with respect to the collar.

* * * * *